US007308965B2

(12) United States Patent
Sapoval et al.

(10) Patent No.: US 7,308,965 B2
(45) Date of Patent: Dec. 18, 2007

(54) NOISE ABATEMENT WALL

(75) Inventors: Bernard Sapoval, Paris (FR); Marcel Filoche, Paris (FR); Michel Chappat, Maurepas (FR); Didier Peyrard, Mornant (FR)

(73) Assignees: Ecole Polytechnique, Palaiseau (FR); Colas, Boulogne-Billancourt (FR)

( * ) Notice: Subject to any disclaimer, the term of this patent is extended or adjusted under 35 U.S.C. 154(b) by 323 days.

(21) Appl. No.: 10/508,119

(22) PCT Filed: Mar. 19, 2003

(86) PCT No.: PCT/FR03/00881

§ 371 (c)(1),
(2), (4) Date: Sep. 16, 2004

(87) PCT Pub. No.: WO03/078740

PCT Pub. Date: Sep. 25, 2003

(65) Prior Publication Data

US 2005/0103568 A1 May 19, 2005

(30) Foreign Application Priority Data

Mar. 19, 2002 (FR) ..... 02 03404

(51) Int. Cl.

| | |
|---|---|
| ***G10K 11/16*** | (2006.01) |
| ***E04B 1/82*** | (2006.01) |
| ***E04B 1/84*** | (2006.01) |
| *E04H 17/14* | (2006.01) |

(52) U.S. Cl. ..... 181/210; 181/293; 181/286

(58) Field of Classification Search ..... 181/210, 181/293, 295, 286, 285, 284; 52/144, 145
See application file for complete search history.

(56) References Cited

U.S. PATENT DOCUMENTS

| | | | | | |
|---|---|---|---|---|---|
| 1,791,232 | A | * | 2/1931 | Borkenstein | 181/293 |
| 2,771,164 | A | * | 11/1956 | Scurlock | 52/404.1 |
| 2,792,164 | A | * | 5/1957 | Cauffiel | 182/194 |
| 2,840,179 | A | * | 6/1958 | Junger | 181/286 |
| 3,232,371 | A | * | 2/1966 | Reichert et al. | 181/293 |
| 3,722,619 | A | * | 3/1973 | Higgs | 181/286 |
| 3,814,208 | A | * | 6/1974 | Morresi et al. | 181/293 |
| 4,242,398 | A | * | 12/1980 | Segawa et al. | 428/172 |
| 4,425,981 | A | * | 1/1984 | Kiesewetter et al. | 181/286 |
| 4,555,433 | A | * | 11/1985 | Jablonka et al. | 428/166 |
| 5,024,290 | A | * | 6/1991 | Birker | 181/293 |
| 5,027,920 | A | | 7/1991 | D Antonio et al. | |
| 5,160,816 | A | * | 11/1992 | Chlop | 181/285 |
| 5,193,318 | A | | 3/1993 | D Antonio et al. | |
| 5,250,763 | A | * | 10/1993 | Brown | 181/155 |

(Continued)

FOREIGN PATENT DOCUMENTS

DE 3313813 A1 * 10/1984

(Continued)

*Primary Examiner*—Edgardo San Martin
(74) *Attorney, Agent, or Firm*—Young & Thompson

(57) ABSTRACT

A noise-absorbing device includes a substantially flat base and embossed and/or hollow elements each including at least one recess. This base reveals with the embossed and/or hollow elements, a configuration exhibiting a fractality zone of between 1 cm and 50 cm, of fractal dimension greater than 2.5 enabling the localization of the waves over the sound frequency range, in the vicinity of the elements.

22 Claims, 7 Drawing Sheets

U.S. PATENT DOCUMENTS

| | | | | | |
|---|---|---|---|---|---|
| 5,509,247 | A * | 4/1996 | Fortez et al. | 52/630 |
| 5,665,943 | A * | 9/1997 | D'Antonio | 181/295 |
| 5,817,992 | A * | 10/1998 | D'Antonio | 181/295 |
| 6,772,859 | B2 * | 8/2004 | D'Antonio et al. | 181/293 |
| 6,793,037 | B1 * | 9/2004 | Babuke et al. | 181/293 |
| 2003/0006092 | A1 * | 1/2003 | D'Antonio et al. | 181/293 |

FOREIGN PATENT DOCUMENTS

| | | | |
|---|---|---|---|
| DE | 3728103 | A1 * | 3/1989 |
| EP | 0 214 524 | | 3/1987 |
| FR | 2 231 825 | | 12/1974 |
| FR | 2231825 | A * | 1/1975 |
| FR | 2 712 902 | | 6/1995 |
| JP | 01226906 | A * | 9/1989 |
| JP | 05002395 | A * | 1/1993 |
| JP | 05150791 | A * | 6/1993 |

* cited by examiner

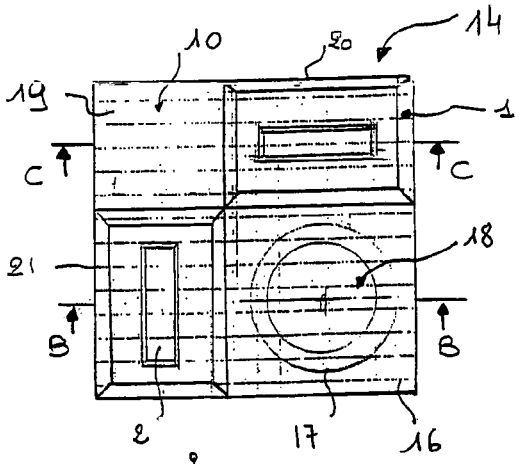
FIG. 5a
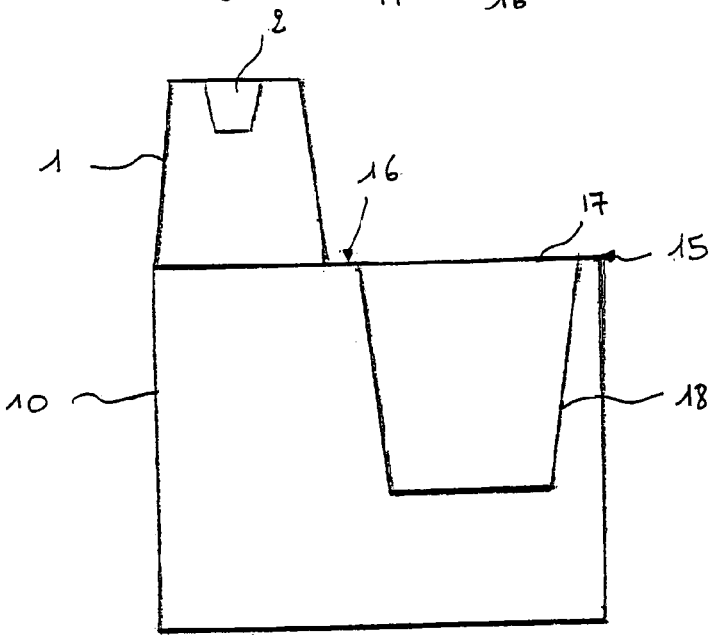
FIG. 5b
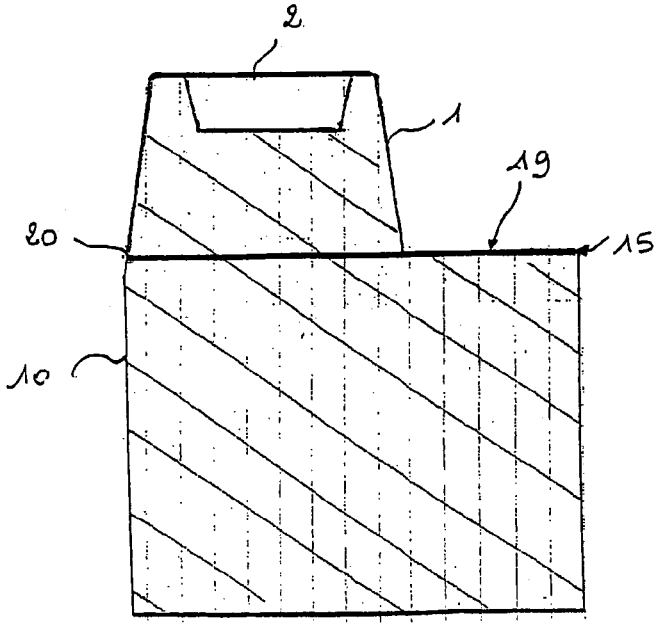
FIG. 5c
FIG. 5

NOISE ABATEMENT WALL

BACKGROUND OF THE INVENTION

The present invention relates to a soundproof wall. It aims at limiting the effects of the noise, among other things noises issued from various modes of transportation (roads, railways, airports). This soundproof device may be arranged on any type of infrastructure (wall, ceiling, floor, tunnel, building, . . . ).

The solution consisting in covering certain portions of roads or of motorways is not always possible. Often, it is sought to attenuate, if not to suppress, the effects of the noise by the construction on the bank of the carriageway, soundproof walls, also called acoustic screens, along the existing carriageways.

The conception of these soundproof walls results from the application of the circular R/A 89.66 dated 17 May 1989 which defines the requirements thereof in terms of noise, aesthetics and cost.

Generally, it is known that the sizing method of such walls is based on the calculation of the direct transmissions and on the calculation of sound attenuation by absorption, by reflection and by diffraction.

The absorbing panels are generally in the form of a caisson wherein is placed an absorbing material such as mineral wool, clay foam, etc. . . . whereas the masking panels are made of a hard wall such as glass, smoothed concrete, etc . . . .

The present invention falls into the former category, i.e the field of sound-absorbing panels. The device offered forms not only a sound-proof shield, but also enables the absorption thereof and reduces the effect of multiple reflections.

The purpose of the invention is to improve the performances of a soundproof wall fitted with absorbing panels while offering a new geometry consisting, among other things, in increasing the interaction surface of the acoustic waves with a partially absorbing material.

The invention falls within the framework of so-called fractal geometries and space filling surfaces. In particular, it has been sought here to realise such an object in a practical manner, which imposes a restriction on the first orders of fractality.

SUMMARY OF THE INVENTION

To this end, the invention relates to a sound-absorbing device notably for roads and railways including an approximately flat base, embossed and/or hollow elements each including at least one recess.

According to the invention, this base reveals, with the embossed and/or hollow elements, a configuration exhibiting a fractality over a length range comprised between 1 cm and 50 cm, of fractal dimension greater than 2.5 enabling the localisation of certain acoustic modes in the vicinity of said elements.

By fractal dimension D is meant here the average exponent expressing the measurement of the total surface area S(R) separating the air and the absorbing medium and included in a sphere of radius R, centred on this separation surface, in relation to this radius, in the form S(R) proportional to R at the power of D, ($S(R)=k\ R^D$).

The present invention also relates to the characteristics which will appear in the following description and which should be considered individually or according to all their technically possible combinations:

the embossed elements are truncated cones;

A cone is an embossed element whereof the surface is generated by a straight line running through a point, called apex, and resting on a curve plotted in a plane not running through said point. Here, the expression truncated cone refers to a cone whereof the axis is the straight line connecting its apex to the centre of its base but which is limited to its upper section by the intersection of the cone with a plane, the embossed elements are truncated pyramids;

A pyramid is a polyhedron limited by a flat base in the form of a polygon and lateral faces composed of triangles bearing on this polygon having a common apex. The surface of such a pyramid is obtained, here, by a straight line running through an apex and resting on a polygonal base, plotted in a plane not including the apex. Here, the expression truncated pyramid means a pyramid whereof the axis is the straight line connecting its apex to the centre of its base but which is limited to its upper section by the intersection of the pyramid with a plane, the pyramidal form being the general outer envelope of these truncated pyramids.

the base truncated pyramids is rectangular;

the recess is a hollow truncated cone whereof the axis is the straight line connecting the apex of the embossed elements at the centre of their base, said truncated cones being open on the upper section side of the embossed elements;

the recess is a hollow truncated cone whereof the axis is parallel to the base of said elements, said truncated cones being open at their ends;

the plane delineating the upper section of the embossed elements forms an angle $\phi$ with respect to the plane running through the base of said elements;

the embossed elements are made of a phonically absorbing material;

Theoretically, any material is phonically, partially absorbing. In practice, it is however usual to class the materials in two categories, respectively non-absorbing and absorbing. A material is called non-absorbing when the sound absorption for a reflection on a hard wall composed of this material is smaller than $10^{-2}$ approximately.

the embossed elements are made of concrete-wood;

the embossed elements are covered with a phonic absorbing material;

the embossed elements are grouped in caissons having a flat base whereon are formed the embossed elements;

the embossed elements are separated by recesses formed in the base;

the recesses are truncated cones open on the upper section side of the base;

a recess and two embossed elements form an elementary mesh;

the caisson is formed of a periodic arrangement of the same elementary mesh;

the device is composed of several caissons forming a wall, the caissons having their bases parallel to the surface of the wall;

the caissons are arranged randomly with respect to one another;

the embossed elements are truncated pyramids and the caissons are grouped in pairs to form a succession of reverted pyramids;

the device is composed of several caissons forming a wall, the caissons having their bases respectively either parallel or perpendicular to the surface of the wall;

caissons directed respectively towards both faces of the wall are associated;

caissons are associated, from top to bottom, in the following order by designating with the letter A, a caisson whereof the base is perpendicular to the surface of the wall and B, a caisson whereof the base is parallel to the surface of the wall:

A B A A B A the caissons of type A are distributed in two categories, respectively, $A_1$ and $A_2$ perpendicular to one another.

BRIEF DESCRIPTION OF THE DRAWINGS

The following description given by way of non-limiting example will show more clearly how the invention may be realised. It is made with reference with the appended drawings whereon:

FIG. 5 represents schematically the elementary mesh implemented to form the caisson of FIG. 4 (FIG. 5*a*), a sectional view according to the axis B-B of this mesh (FIG. 5*b*) and a sectional view according to the axis C-C of said mesh (FIG. 5*c*);

DETAILED DESCRIPTION OF THE PREFERRED EMBODIMENTS

The sound-absorption device according to the invention implements the dampening design of fractal acoustic resonators. Here, the expression fractal object means an object whereof the geometry may be described by a non-integer dimension. This approach aims at realising a phonically absorbing object exhibiting maximal surface areas in a given volume, i.e. an object having a space filling surface. This is meant in the sense when the total surface area comprises in a sphere of radius R centred on the object varies more quickly when R increases than the square of the radius R. Such an object exhibits a very irregular geometry which enables the localisation of the modes of the waves over the sound frequency range, in the vicinity of the surfaces. The localisation of these modes for given frequencies, i.e. their concentration in a region of the space close to the phonically absorbing surfaces causes excessive dampening effect of these modes. This excessive dampening effect results from the increase in the amplitude of the modes on the absorbing surface. There is a kind of increased "friction" of the modes of the waves against the absorbing material. Two kinds of modes are therefore distinguished delocalised modes, for which the absorption by said device is amplified by the considerable increase of the absorbing surface with respect to a simple flat surface and localised modes, for which excessive dampening effect can be observed, added to the absorption already observed previously for the delocalised modes.

The sound-absorbing device according to the invention comprises therefore a substantially flat base, embossed and/or hollow elements 1, each including at least one recess or scalloping 2. According to the invention, this base reveals with the embossed and/or hollow elements a configuration exhibiting a fractality zone comprised between 1 cm and 50 cm, of fractal dimension greater than 2.5. The device exhibits advantageously variable sizes, in the planes parallel to the base plane, in relation to their distance to said plane of the base. In a preferred embodiment, these sizes and their variations are at least partially irregular. A fractal object has thus been realised in the first order of approximation.

Figure 1:
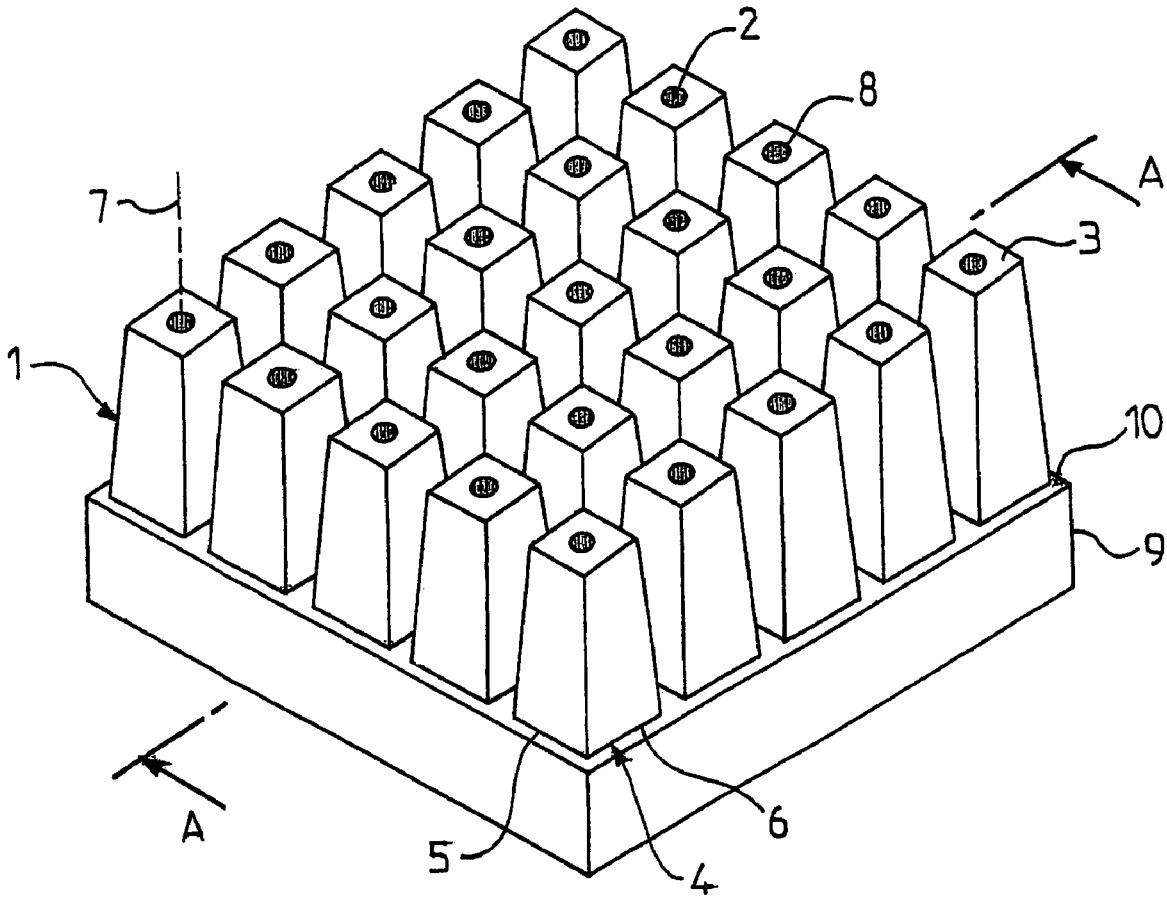
FIG. 1 is a perspective schematic representation of a caisson implemented in an embodiment of the invention.

In an embodiment, the surface of the embossed and/or hollow elements 1 is generated by a straight line running through an apex and resting on a closed line contained in a plane not running through said apex, said elements 1 being truncated in their upper section 3 by a plane. The closed line may, for example, forms a curve or a polygon. Here, the word base 4 refers to the surface circumscribed by the closed line wherefrom the height of the solid element is calculated in a perpendicular fashion. Advantageously, this closed line describes the contour of a 'kouglof' mould, i.e. it comprises a succession of arcs of circle forming a closed line. In a first embodiment, the embossed elements 1 are truncated pyramids 1 such as those represented on FIG. 1. The truncated pyramid includes a square base 4 whereof two sides 5 and 6 are apparent on the perspective diagram of FIG. 1 and an upper section 3. In a second embodiment, the embossed elements 1 are truncated cones.

Each of the embossed elements 1 is emptied, so that it includes a hollow truncated cone 2. This truncated recess 2 may, in a first embodiment, have the straight line connecting the apex of the pyramid at the centre of its base 4 as the axis 7 or, in a second embodiment, have its axis 7 parallel to the base 4 of the elements 1. In the first embodiment, the truncated cones 2 are open on the upper section side 3 of the truncated pyramids 1. In the second embodiment, the truncated cones 2 are open at their ends 8.

A theoretical approach has been developed to explain the increase in the sound-absorbing properties by a device composed of such a substantially flat base and of such embossed elements 1.

This theory distinguishes two types of mode, localised modes and delocalised modes. For the latter, the increase in the absorbing power results from the "developed surface" of the wall with respect to its projected surface. The projected surface of the wall is that formed generally and which may be defined as being the surface seen on a macroscopic plane from the sound source. It is of the surface occupied by the device or the wall.

The developed surface is the accumulation of the set of the surfaces, external or internal surfaces, of the absorbing device in contact with air, i.e. with sound waves.

Thus, this developed surface will be, in case when the embossed elements 1 are truncated pyramids, the result from the accumulation of the surfaces of the lateral faces of the truncated pyramids 1 and of the internal surfaces of the hollow truncated cones 2.

It has been noted that the sound absorption obtained with such a device is then proportional to the ratio S of the developed surface $S_d$ to the projected surface of the wall $S_m$.

For the so-called localised modes, a localisation zone of the sound wave may be observed in the vicinity of the structure absorbing, resulting from the presence of irregularities in said structure. This wave is therefore subjected to a friction phenomenon with the phonically absorbing material which induces excessive dampening effect thereof. This excessive dampening effect will increase the absorbing power already observed for delocalised modes.

The absorbing power by average square meter of projected surface of the device and for a given frequency ω of the sound, is increased by a factor A(ω) given by the formula:

$$A(\omega)=(S_d/S_m)\times C(\omega)$$

where $S_d$ and $S_m$ are respectively the developed surface and the projected surface of the wall and C(ω) is the form factor such as:

C(ω)=1 for frequencies corresponding to delocalised modes, and C(ω)>1 for frequencies corresponding to localised modes.

These theoretical explanations which lead to the same practical realisations, are given here to enable better understanding of the invention and of its extent.

In the following description, we shall consider the case when the embossed elements 1 are, according to a preferred embodiment, truncated pyramids. The invention will not be limited, however, to such an embodiment. Another preferred embodiment of the invention being, for example, truncated cones.

Figure 2:
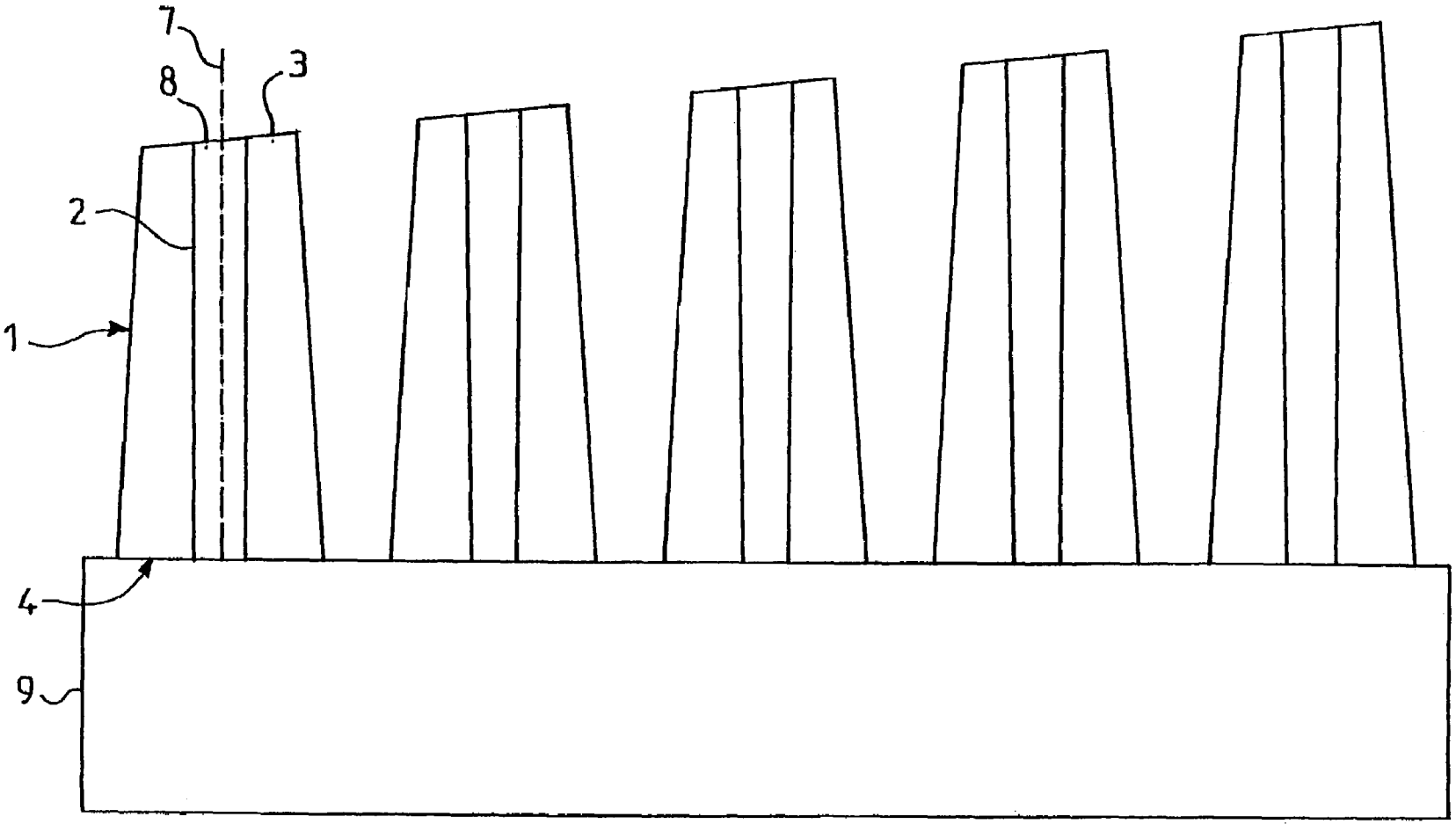
FIG. 2 is a sectional schematic representation according to the axis A-A of a caisson implemented in an embodiment of the invention.
Figure 3:
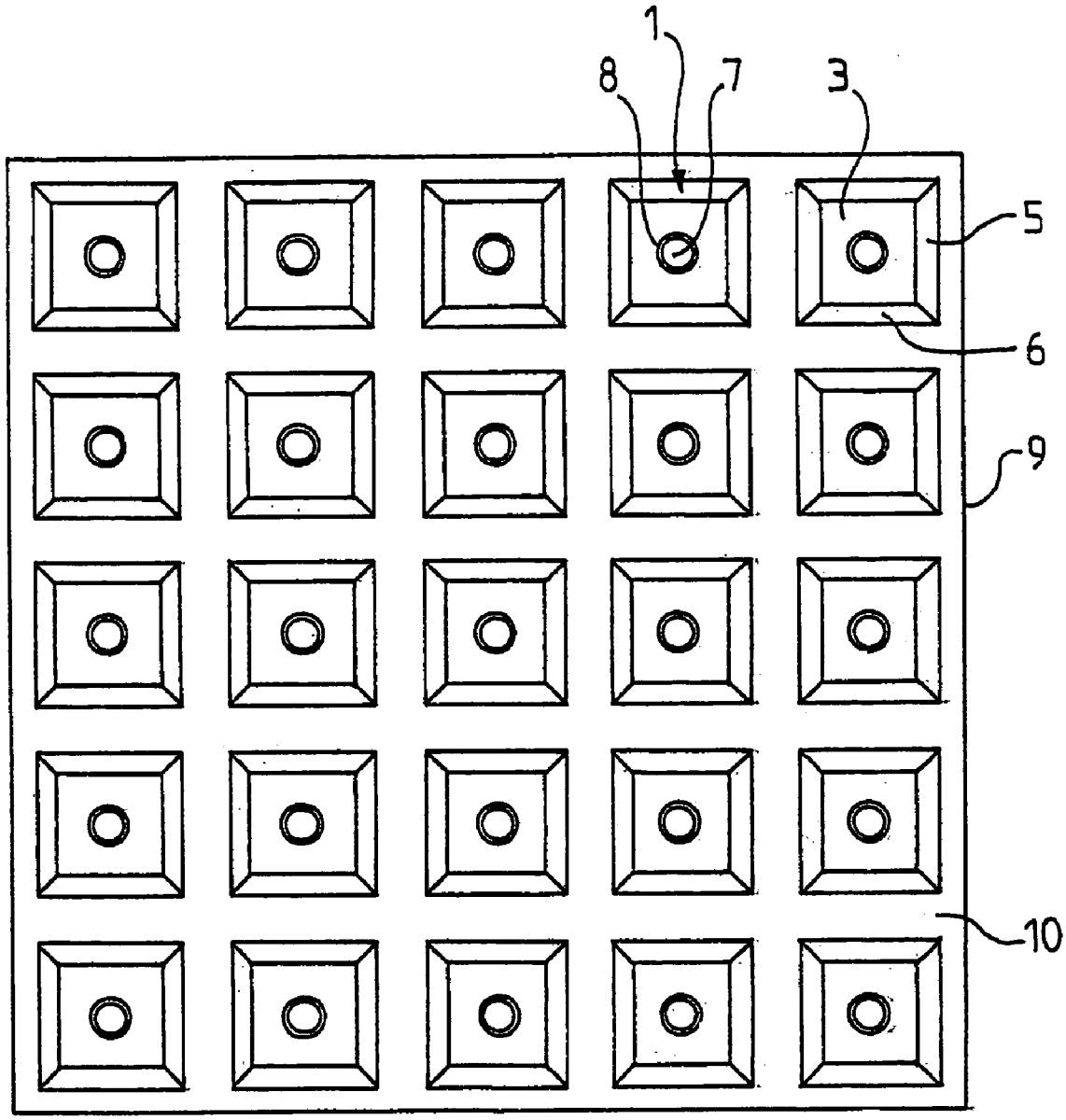
FIG. 3 is a top view of the caisson of FIG. 1.

As represented on FIGS. 2 and 3, the truncated pyramids 1 are advantageously reunited into caissons 9 liable to be used, either directly, or by the association of several of them, to form a wall.

The axes 7 of these truncated pyramids 1 are advantageously parallel to one another and their associated bases 4, in order to form a base 10 of the caisson 9 which is plane. The axis 7 of the truncated pyramids 1 may be tilted by an angle θ ranging between 0 and 5° with respect to the normal to the plane running through the base 4 of the solid elements 1.

The plane delineating the upper section 3 of said truncated pyramids 1 forms an angle ϕ with respect to the plane running through the base 10 of the caisson 9. This angle ϕ is advantageously comprised between 2 and 10°. In a preferred embodiment, this angle ϕ is 6°.

These small values for the angle ϕ ensure easy casing removal and are therefore suited to the realisation constraints by direct moulding.

Advantageously, the presence of this tilted plane enables variation in height of the embossed elements 1 and thus reinforces the irregularities of the device which enables widening of the frequency range wherefore is observed the localisation of the modes of the waves and hence an excessive dampening effect.

The sizes of the square bases 4 are comprised between 50 and 140 mm. the heights of the truncated pyramids 1 are comprised between 220 and 350 mm.

In a particular embodiment (see FIG. 3), a set of 5×5=25 truncated pyramids 1 whereof the base 4 is a 90 mm square a side has been realised. The height of the truncated pyramid 1 is of 240 mm.

For easy casing removal when making these caissons 9, a 30 mm spacing is used between each truncated pyramid 1.

Figure 4:
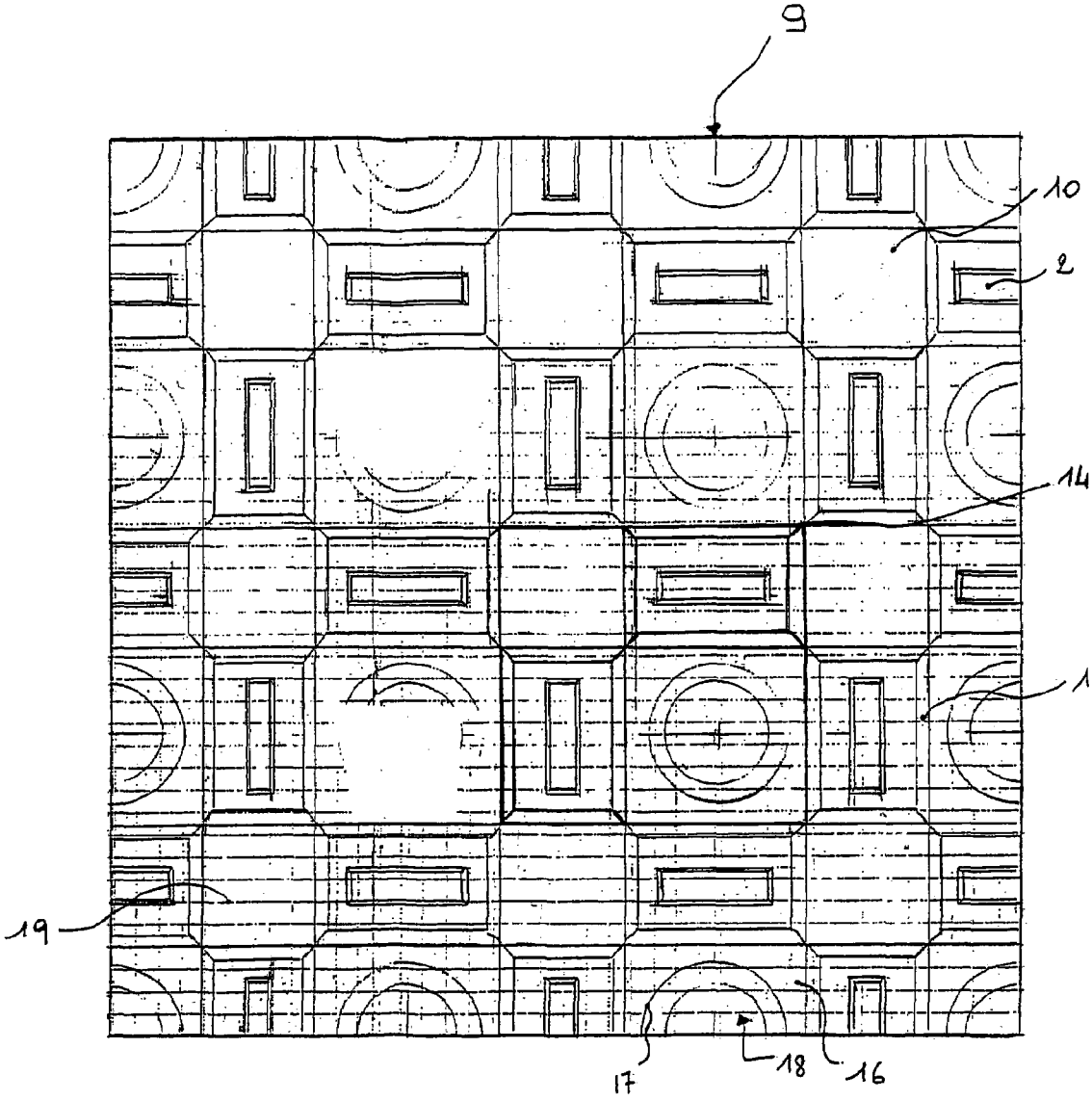
FIG. 4 is a schematic view of a caisson implemented in another embodiment of the invention, formed by a periodic arrangement of the same elementary mesh.

In another embodiment, the embossed elements 1 formed on the base 10 plane of the caissons 9, are separated by recesses 2 realised in the base 10 which form hollow elements. The presence of these recesses improves the absorbing power of the device by increasing advantageously the developed surface of the caisson 9 with respect to its projected surface. These recesses 2 are, for example, truncated cones open on the upper section side of the base 10. The caisson 9 may, moreover, be formed by a periodic arrangement of the same elementary mesh 14. FIG. 4 shows such an arrangement, in a preferred embodiment, offering simultaneously high absorbing power and easy casing removal during manufacture. In this embodiment, the ratio of the developed surface on the projected surface is of the order of 10.

FIG. 5 shows schematically a top view of the elementary mesh 14 (FIG. 5*a*) used for obtaining the periodic arrangement of the caisson 9 of FIG. 4. This elementary mesh 14 has in the upper plane 15 of the base 10 a square surface which comprises a first square 16 where the side has a length 'a' comprising the open base 17 of a recess in the form of a truncated cone 18 with circular base 17. The elementary mesh 14 also comprises in this upper plane 15, a second square 19 where the side has a length b with b<a, and the rectangular bases 20-21 of two embossed elements 1, these elements 1 being truncated pyramids. Each of the embossed elements 1 is emptied, so that it includes a hollow truncated cone 2. This truncated recess 2 has a straight line connecting the apex of the pyramid to the centre of its base 20-21 as an axis. FIG. 5*b*) shows a sectional view according to the axis B-B of this elementary mesh and FIG. 5*c*) shows a sectional view of this elementary mesh 14 according to the axis C-C.

Figure 6:
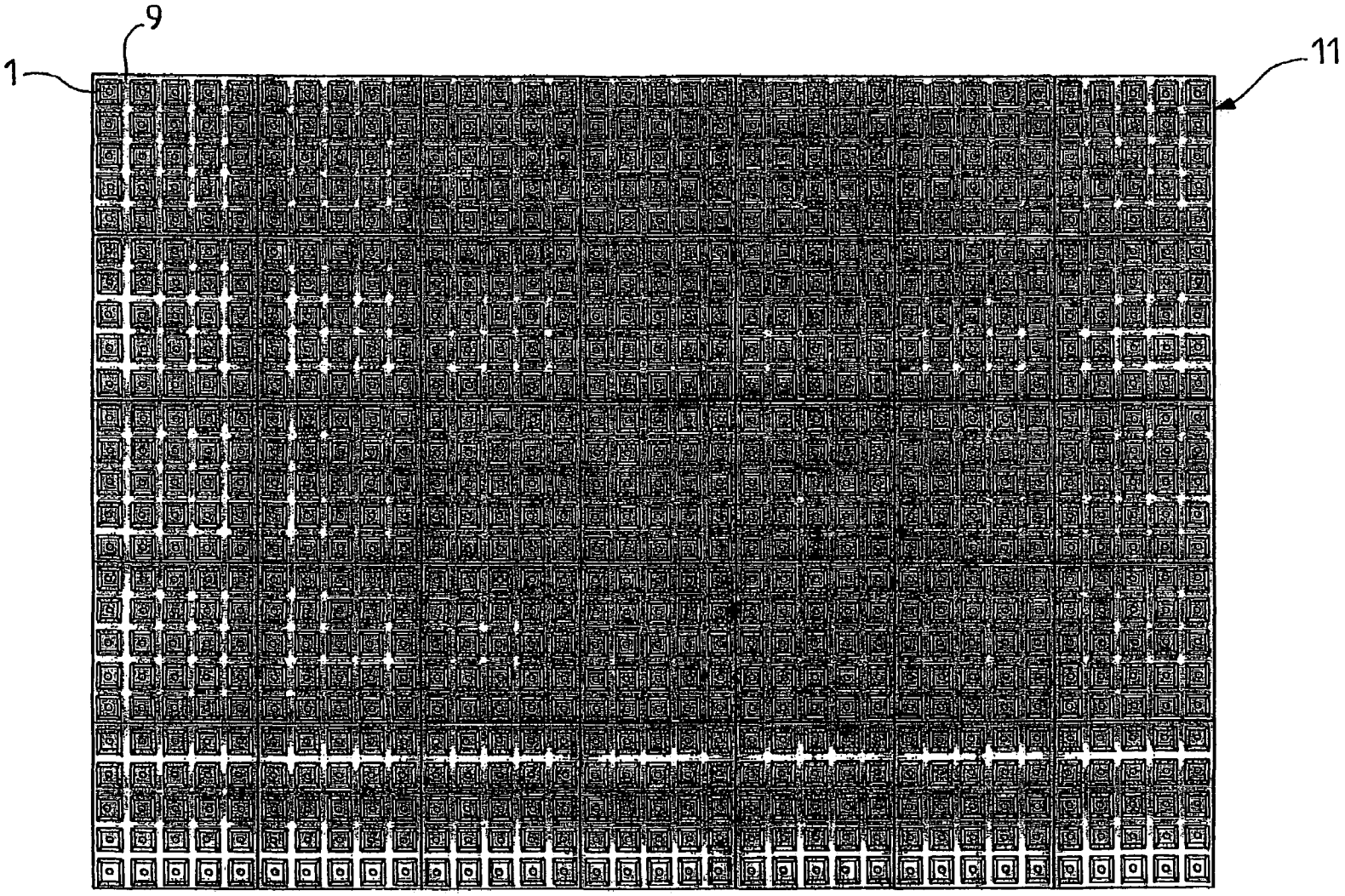
FIG. 6 is a schematic view of a panel formed using a set of caissons of FIG. 1 having their bases parallel to the surface of the panel.

FIG. 6 represents an embodiment of a "type-1 wall" 11 using a set of caissons 9 having their bases 10 parallel to the surface of the "type-1" 11.

By "type-1 wall" 11 is meant a rigid quadrangular flat portion including a limited number of caissons, advantageously 35. These "type-1 wall" 11 may be mounted individually to form a soundproof wall or fixed to a pre-existing support (tunnels, motorway banks, . . . ).

The caissons 9 may be arranged randomly with respect to one another. In a preferred embodiment, the caissons 9 are grouped in pairs, in order to form a succession of reverted pyramids.

Figure 7:
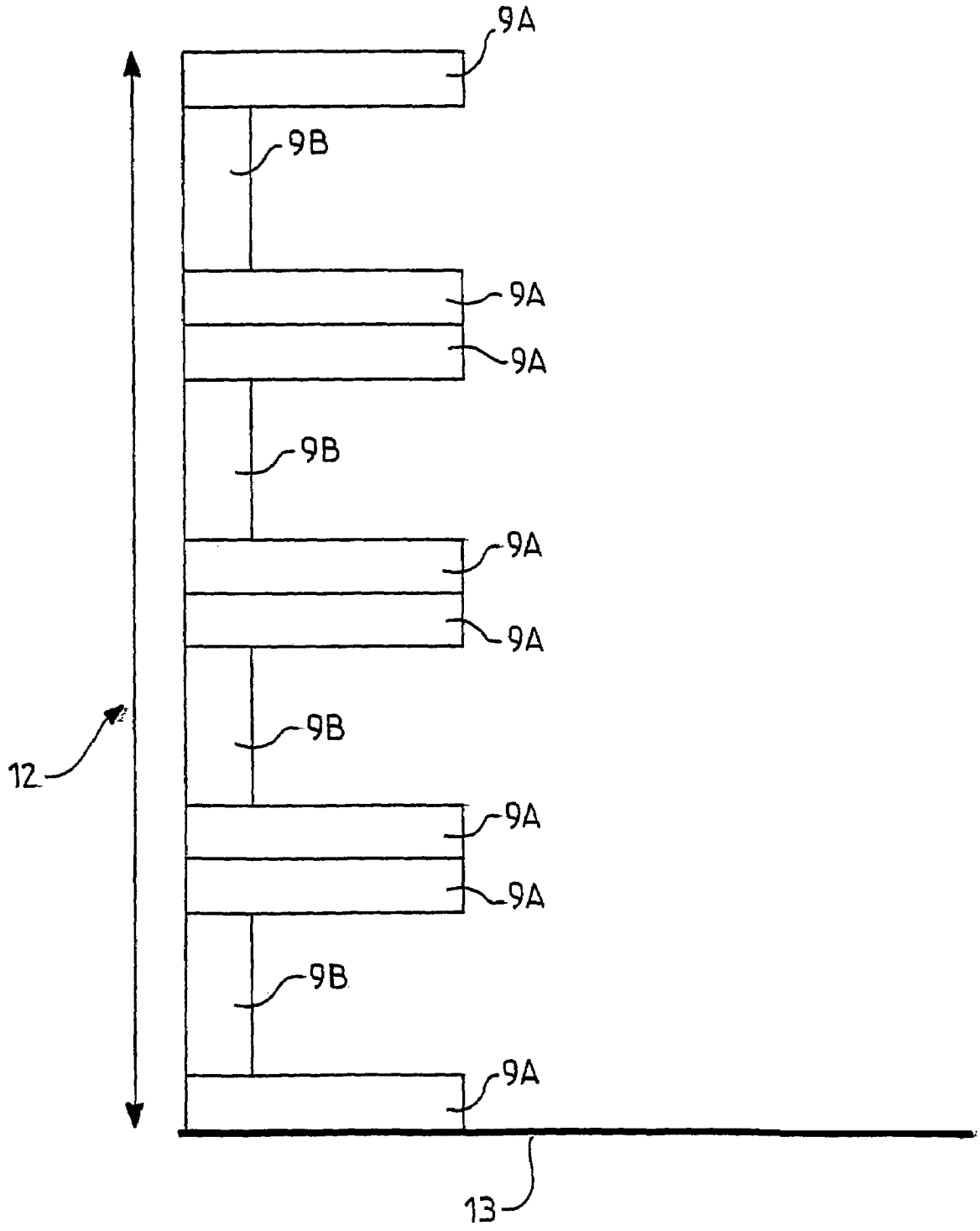
FIG. 7 is a diagram representing the relative arrangements of caissons to form a wall in certain embodiments of the invention.

FIG. 7 represents an optimised embodiment of a "type-2 wall" 12 using a set of caissons 9. This wall may be regarded as a fractal object at the second order of approximation.

This "type-2 wall" 12 is approximately perpendicular to the carriageway 13. It is formed by the association of caissons 9 classed into two categories, the caissons A designated by $\mathbf{9}_A$ whereof the flat base is perpendicular to the general plane of the wall 12, i.e. for example parallel or perpendicular to the carriageway 13, and the elements $\mathbf{9}_B$ which are perpendicular to the elements $\mathbf{9}_A$.

The end elements at the top and at the bottom of the wall are preferably type-A elements, the type-A or type-B elements are advantageously grouped according to the succession A, B, A, A, B, A. The intermediate pattern A A B being repeated as often as necessary to cover the whole height of the wall relative to the size of the caissons 9.

In a preferred embodiment, one of the sizes of the base 9 of the caissons $\mathbf{9}_B$ which will be called, for example, their width, is half of their other sizes, i.e. their length.

In another preferred embodiment, the type-A caissons 9 are distributed in two categories, respectively, $A_1$ and $A_2$ perpendicular to one another. There is thus provided a type-3 wall, a fractal object of order three in approximation. One obtains thus a factor-five dampening effect relative to the type-1 wall.

The invention has been described until now while considering the utilisation of little absorbing materials. One may still improve the absorption of the device of the invention while making it out of an absorbing material such as, for example concrete-wood, wherefore it is known that the average sound absorption is of the order of 0.5 to 0.7.

It is well known that concrete-wood is the material realised with wood chippings connected together by a cement-like matrix. The wood material used is of Epicea or Douglas Pine type having been advantageously subjected to an antifouling treatment. For one cubic meter of wood chippings, one uses conventionally approximately 410 kg cement. Advantageously, the proportion of the number of wood chippings with respect to the quantity of cement implemented to realise the cement-like matrix is adapted to modify the average dimensions of the vacuums created in the concrete and thereby increase the absorbing power of the absorbing material.

The porous concrete, the concrete including expanded clay balls or any other honeycomb absorbing material may also be implemented.

In another embodiment, the device, according to the invention, is covered with a phonically absorbing material.

In the description made until now, one has endeavoured to realise a wall 12 intended for the absorption of the noise generated on only one of its sides. It might be useful to provide an absorbing device on both its faces, which would enable in particular to reduce the noises reflected by buildings by diffraction or multiple reflections, in the vicinity of a road.

In such a case, the wall 12 will be made by association of caissons 9 directed to the road on the one hand, to the buildings on the other hand.

This noise-absorbing device may advantageously be implemented for limiting the noise pollution derived from diverse modes of transportation (roads, railways). It may be arranged on any type of infrastructure (wall, ceiling, floor, tunnel, building, . . . ).

This sound-absorbing device is advantageously anti-tag.

What is claimed is:

1. A sound-absorbing device, notably for roads and railways including:

a substantially flat base with two opposing sides, and embossed elements on an upper side of the base, each embossed element including at least one recess, said embossed elements being made of a phonically absorbing material, wherein the recess does not communicate with the side of the base opposite to the upper side and said base forms with the embossed elements a configuration exhibiting a fractality over a length range comprised between 1 cm and 50 cm, with a fractal dimension greater than 2.5 enabling the localisation of acoustic modes, in the vicinity of said embossed elements.

2. A sound-absorbing device according to claim 1, wherein the embossed elements are truncated cones.

3. A sound-absorbing device according to claim 1, wherein the embossed elements are truncated pyramids.

4. A sound-absorbing device according to claim 3, wherein the base of the truncated pyramids are rectangular.

5. A sound-absorbing device according to claim 1, wherein the recess is a hollow truncated cone whose axis is a straight line connecting an apex of the embossed elements at a centre of their base, said truncated cones being open on an upper section-side of the embossed elements.

6. A sound-absorbing device according to claim 2, wherein the recess is a hollow truncated cone having an axis parallel to the base of said embossed elements, said truncated cones (2) being open at their ends.

7. A sound-absorbing device according to claim 1, wherein a plane delineating an upper section of the embossed elements forms an angle $\phi$ with respect to a plane running through the base of said elements.

8. A sound-absorbing device according to claim 1, wherein the embossed elements are made of concrete-wood.

9. A sound-absorbing device according to claim 1, wherein the embossed elements are covered with an absorbing material.

10. A soundabsorbing device according to claim 1, wherein the embossed elements are grouped in caissons having a flat base whereon are formed the embossed elements.

11. A sound-absorbing device according to claim 10, wherein the embossed elements are separated by hollow elements formed in the base.

12. A sound-absorbing device according to claim 11, wherein the hollow elements are truncated cones open on the upper section side of the base.

13. A sound-absorbing device according to claim 11, wherein one hollow element and two embossed elements form an elementary mesh.

14. A sound-absorbing device according to claim 13, wherein the caisson is formed of a periodic arrangement of the same elementary mesh.

15. A sound-absorbing device according to claim 10, composed of several caissons forming a wall, the caissons having their bases parallel to the surface of the wall.

16. A sound-absorbing device according to claim 15, wherein the caissons are arranged randomly with respect to one another.

17. A sound-absorbing device according to claim 16, wherein the embossed elements are truncated pyramids and the caissons are grouped in pairs to form a succession of reverted pyramids.

18. A sound-absorbing device according to claim 15, composed of several caissons forming a wall, the caissons having their bases respectively either parallel or perpendicular to the surface of the wall.

19. A sound-absorbing device according to claim 18, wherein the caissons are directed respectively towards both faces of the wall.

20. A sound-absorbing device according to claim 18, wherein the caissons are associated, from top to bottom, in the following order by designating with the letter A, a first caisson whereof the base is perpendicular to the surface of the wall and B, a second caisson whereof the base is parallel to the surface of the wall:

A B A A B A

21. A sound-absorbing device according to claim 20, wherein the caissons of type A are distributed in two categories, respectively, $A_1$ and $A_2$ perpendicular to one another.

22. A sound-absorbing device, comprising:

a substantially flat base with two opposing sides; and a plurality of discrete embossed elements on an upper side of the base, each embossed element including at least one recess, wherein the recess does not communicate with a side of the base opposite to the upper side and said base forms with the embossed elements a configuration exhibiting a fractality over a length range comprised between 1 cm and 50 cm, with a fractal dimension greater than 2.5 enabling the localisation of acoustic modes, in the vicinity of said embossed elements.

* * * * *